United States Patent [19]

Soileau

[11] 4,069,442

[45] Jan. 17, 1978

[54] PULSE CIRCUIT FOR GASEOUS DISCHARGE LAMPS

[75] Inventor: Trasimond A. Soileau, Flat Rock, N.C.

[73] Assignee: General Electric Company

[21] Appl. No.: 692,080

[22] Filed: June 2, 1976

[51] Int. Cl.[2] ..... H05B 41/30

[52] U.S. Cl. ..... 315/208; 315/194; 315/205; 315/244; 315/283; 315/290; 307/252 M; 328/59

[58] Field of Search ..... 315/194, 199, 205, 208, 315/244, 283, 289, 290, DIG. 5, DIG. 7; 328/59; 307/252 J

[56] References Cited

U.S. PATENT DOCUMENTS

| | | | |
|---|---|---|---|
| 3,344,310 | 9/1967 | Nuckolls | 315/DIG. 5 |
| 3,518,486 | 6/1970 | Babcock | 315/194 |
| 3,555,302 | 1/1971 | Nuckolls | 315/240 X |
| 3,629,683 | 12/1971 | Nuckolls | 315/242 X |
| 3,953,763 | 4/1976 | Herrick | 315/DIG. 7 |

*Primary Examiner*—Eugene R. LaRoche
*Attorney, Agent, or Firm*—Sidney & Greenberg

[57] ABSTRACT

Circuit operating from a direct current source applies DC pulses to a high pressure sodium vapor lamp to improve the color rendition of the lamp. The circuit includes a thyristor switch in series with the lamp, an RC timing circuit for periodically turning on the switch at predetermined intervals, and an LC circuit for turning the switch off. An inductor in series with a diode across the capacitor of the LC circuit provides for discharge of the capacitor to enable subsequent re-charging thereof, so as to provide the desired pulsed operation of the circuit. This mode of operation also provides for application of voltage to the lamp which is substantially higher than the supply voltage.

18 Claims, 5 Drawing Figures

PULSE CIRCUIT FOR GASEOUS DISCHARGE LAMPS

The present invention relates to operating circuits for gaseous discharge lamps, and more particularly concerns direct current operating circuits for sodium vapor discharge lamps.

It is a general object of the invention to provide an improved DC operating circuit for pulsed operation of loads.

It is a particular object of the invention to provide an improved DC operating circuit for applying DC pulses to gaseous discharge lamps, especially of high pressure sodium vapor type, to produce improved color properties of the lamp light output.

It is another object of the invention to provide a circuit of the above type which is simple in construction and efficient and reliable in operation.

Still another object of the invention is to provide a circuit of the above type which produces pulses of sufficiently high voltage to ensure continuous operation of the lamp.

Other objects and advantages will become apparent from the following description and the appended claims.

With the above objects in view, the present invention in a broad aspect relates to a load operating circuit comprising, in combination, a direct current power source, a load connected across the power source, a first inductor, a controlled switch and a capacitor connected in series with the load, and a second inductor of higher inductance than the first inductor connected to the controlled switch for intermittently operating the same, whereby pulses are applied to the load for operation thereof.

In a typical embodiment of the invention, the load is constituted by a gaseous discharge lamp of high pressure sodium vapor type and the controlled switch is a silicon controlled rectifier.

The operating circuit of the invention may be used for applying DC pulses of predetermined duty cycle and repetition rate on the lamp for improving the color and other properties of the lamp. A method and apparatus for pulsed operation of high pressure sodium vapor lamps for improving the color rendition of such lamps are disclosed in co-pending application Ser. No. 649,900 - Osteen, filed Jan. 16, 1976 and assigned the same assignee as the present invention.

As disclosed in the Osteen application, the high pressure sodium vapor lamp typically has an enlongated arc tube containing a filling of xenon at a pressure of about 30 torr as a starting gas and a charge of 25 milligrams of amalgam of 25 weight percent sodium and 75 weight percent mercury.

The present invention provides an improved circuit for DC pulsed operation of such lamps in accordance with the method and principles disclosed in the co-pending Osteen application, and the disclosure thereof in that application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without significant loss in efficacy or reduction in lamp life.

The invention will be better understood from the following description taken in conjunction with the accompanying drawing, in which.

Figure 1:
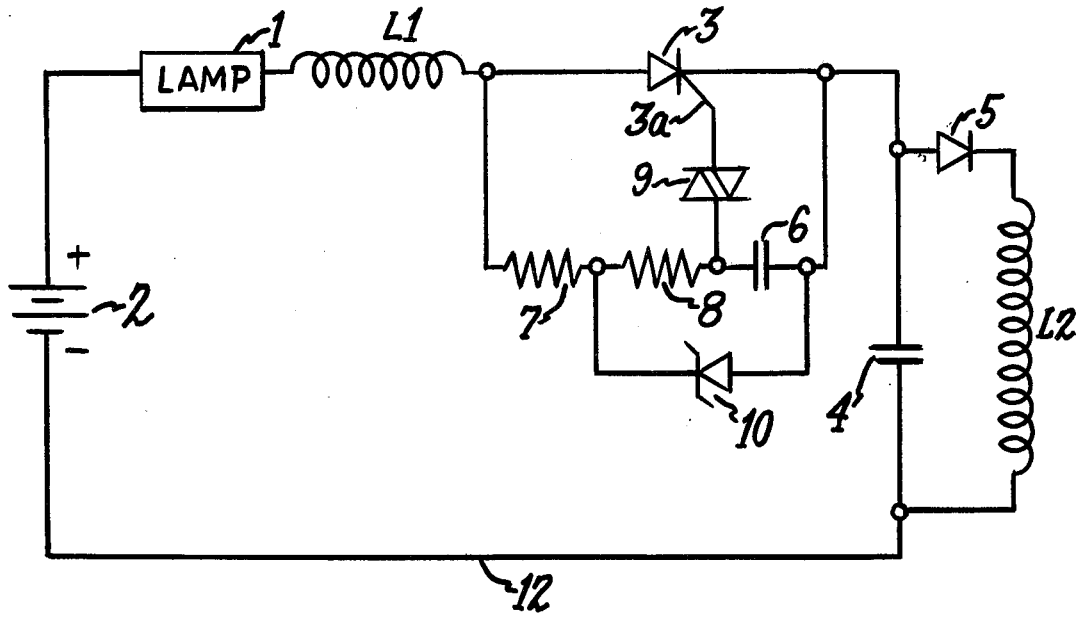
FIG. 1 is a circuit diagram of a DC pulse operating circuit in accordance with an embodiment of the invention.

Referring now to the drawing, and particularly to FIG. 1, there is shown a circuit diagram illustrating an embodiment of the DC pulsing circuit of the invention for operating a gaseous discharge lamp 1.

The lamp, which is typically a high pressure sodium vapor lamp such as described above, is connected at one side to the positive terminal of DC power source 2, which may have a voltage, for example, of about 180 volts. At its other side lamp 1, typically of 330 watts rating, is connected to series-connected inductor L1, a thyristor such as a silicon controlled rectifier (SCR) 3 and capacitor 4 connected by conductor 12 to the negative terminal of DC power source 2 as shown. A second inductor L2 in series with diode 5 is connected across capacitor 4. The operation of SCR 3 is controlled by an RC timing circuit comprising, in the illustrated embodiment, capacitor 6 and resistors 7 and 8 connected across the SCR. A voltage breakdown device 9, constituted by a diac in the circuit shown, is connected at one side to the junction of capacitor 6 and resistor 8 and at the other side to the control electrode (gate) 3*a* of SCR switch 3. Zener diode 10 is connected across capacitor 6 and resistor 8 of the timing circuit.

The inductance of inductor L2 is substantially higher than that of inductor L1, and in a typical circuit for practicing the invention the L2 inductance would be about 10 times that of L1. However, the ratio may be in the range of about 4:1 to about 50:1 or higher while still obtaining satisfactory results. In general, the L2 inductance should be sufficiently high to ensure proper charging of capacitor 4, while the upper limit of its value should be such as to provide for sufficient reversal of the capacitor charge to commutate the SCR switch.

It appears that the use of higher values of inductor L2 tends to reduce circuit losses. Also, it has been found that with sufficiently high inductance of inductor L2, diode 5 may be omitted while still avoiding further reversals of the charge on capacitor 4 as explained below, it being understood that if diode 5 is dispensed with, the values of capacitor 4 and inductor L2 should be such that the pulse voltage available in the circuit is sufficient to re-ignite the lamp.

In a typical circuit, the following components would have the values indicated:

Inductor L1—0.7 millihenries
Inductor L2—7 millihenries
Capacitor 4—3 microfarads
Capacitor 6—.12 microfarad
Resistor 7—41K ohms
Resistor 8—7K ohms
Zener diode 10—62 volts
Diode 5—1K volts
Diac 9—38 volts In the operation of the described circuit, when SCR switch 3 is triggered on by the RC timing circuit, DC current flows through lamp 1, inductor L1 and SCR switch 3, thereby charging capacitor 4, which serves as an energy metering device in the circuit. The charge on capacitor 4 reaches a positive voltage substantially higher than the supply voltage, due to the voltage build up thereon as a result of the operation of the LC circuit comprising inductor L1 and capacitor 4. This causes the SCR cathode voltage to be more positive than its anode voltage, and when this voltage build up is complete and as the current attempts to reverse through the SCR, commutation and turn-off of the SCR occurs. In the absence of the shunt inductor L2, the charge would remain on capacitor 4, thereby preventing subsequent pulsing of lamp 1. In the circuit shown, capacitor 4 discharges and momentarily transfers its energy to inductor L2; subsequently this energy is returned to capacitor 4 but with the polarity of the voltage reversed, such that the upper electrode of capacitor 4 goes to a high negative potential. This negative potential is locked and stored on capacitor 4 by diode 5 and SCR 3. As a result, the voltage across SCR 3 assumes a positive voltage drop from anode to cathode higher than the supply voltage. Diode 5 is included in this LC circuit to inhibit oscillations. The next pulse is then provided by operation of the RC timing circuit, which is adjusted to trigger SCR 3 to produce pulses of the desired repetition rate for pulsing lamp 1 in the manner intended.

On subsequent cycles, the positive voltage drop across SCR 3 increases to even higher levels, until an equilibrium potential is reached as a function of the total resistive losses in the circuit. This equilibrium potential can assume values greater than twice the supply voltage. In an illustrative case, the equilibrium voltage across SCR 3 typically reaches about 450 volts during operation. Such higher voltages, when imposed across lamp 1 during conduction of SCR 3, serve to ensure re-ionization and continued operation of the lamp, especially when the pulse repetition rate is relatively low.

The operation of the RC timing circuit is such that capacitor 6 is charged at a rate determined by the combination of resistors 7, 8 and capacitor 6. When the potential on capacitor 6 reaches the breakdown voltage of diac 9, capacitor 6 discharges through the loop including SCR control electrode 3*a* and turns on SCR 3. While a diac is shown as the voltage breakdown device 9, other breakdown devices such as a silicon bilateral switch (SBS), a Shockley diode, a glow tube, or a series combination of certain of these devices, could be employed.

Zener diode 10 connected to the junction of resistors 7 and 8 of the RC timing circuit stabilizes the frequency of the triggering operation by establishing a fixed clamping voltage toward which capacitor 6 is charged. Resistors 7 and 8 arranged as shown constitute a voltage divider, so that the use of a smaller Zener diode is made possible.

Figure 2:
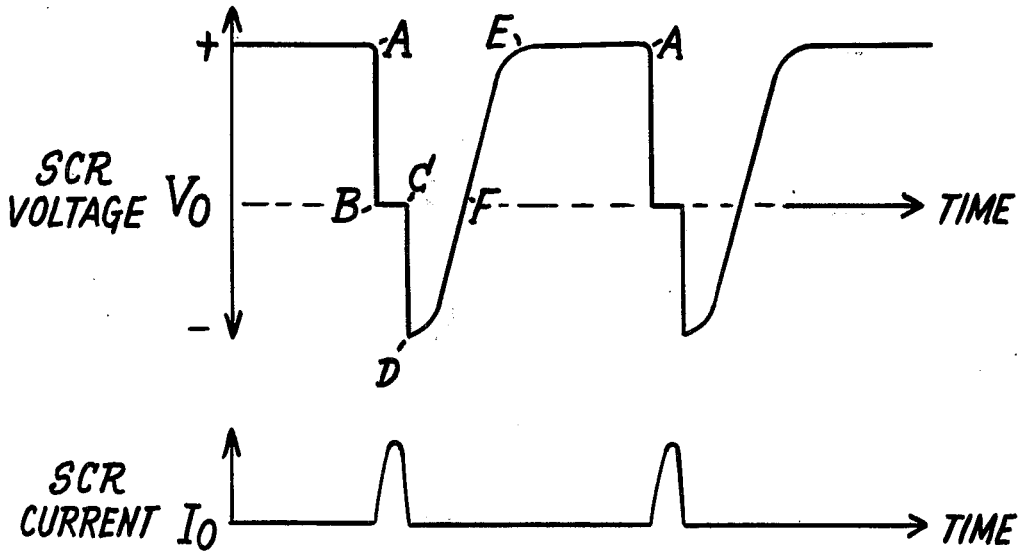
FIG. 2 is a graphical representation of the voltage and current waveforms relating to the operation of the circuit shown in FIG. 1.

FIG. 2 graphically shows the SCR voltage drops and current pulse waveforms achieved after equilibrium is reached in the operation of the described circuit. The initial positive SCR voltage drop shown (anode positive with respect to cathode) prevails before the SCR is gated on. When the SCR switch is turned on at point A, as determined by the RC timing circuit, the voltage across the switch immediately drops to zero, as indicated at point B. The voltage remains zero while the current flows through the SCR switch. During this period, as seen in the SCR current waveform, the current rises to a peak value and then drops to zero due to operation of the LC circuit. The reversal of current is prevented by the SCR, and due to the large positive voltage build up on capacitor 4 as described previously, the SCR is reversed biased to achieve commutation. As the SCR ceases to conduct, as indicated at point C, the voltage drop across the SCR is reversed, i.e., assumes a negative sense with its cathode voltage more positive than its anode voltage as indicated at point D. Capacitor 4 then discharges through diode 5 into inductor L2, producing the SCR voltage waveform portion extending from D to E as the SCR cathode potential is pulled negative by the reversal of charge in capacitor 4 due to the operation of inductor L2. The positive voltage drop is held at level E by diode 5. The RC timing circuit starts the timing interval when the SCR voltage drop goes positive (point F) so that the interval from F to A is determined by the timing circuit.

Figure 3:
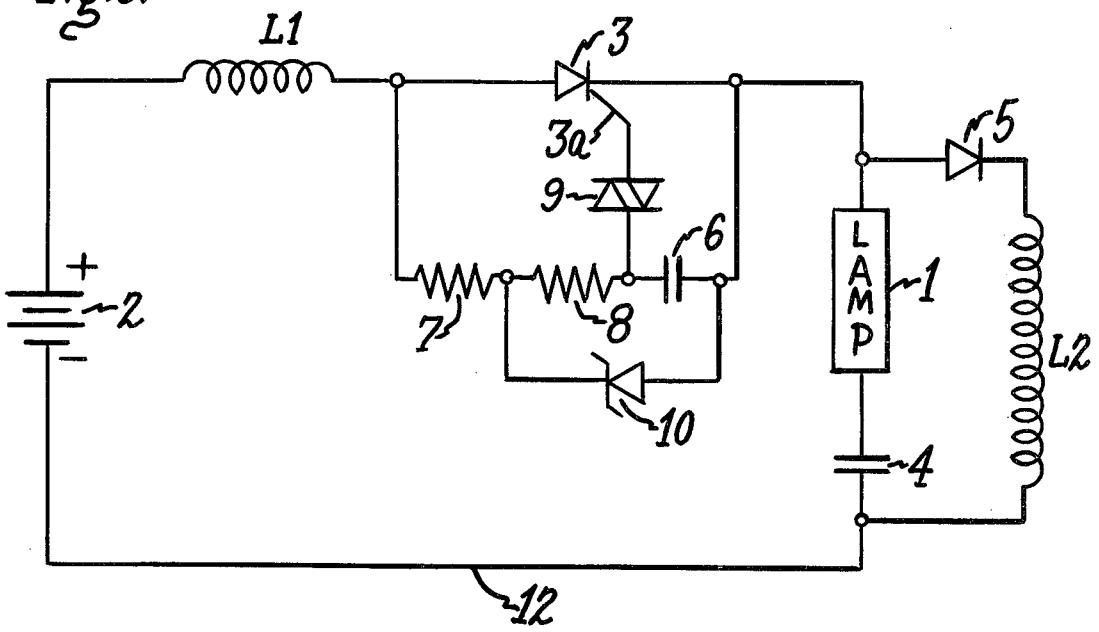
FIGS. 3 and 4 show modifications of the FIG. 1 circuit wherein the lamp is located in different positions in the circuit.
Figure 4:
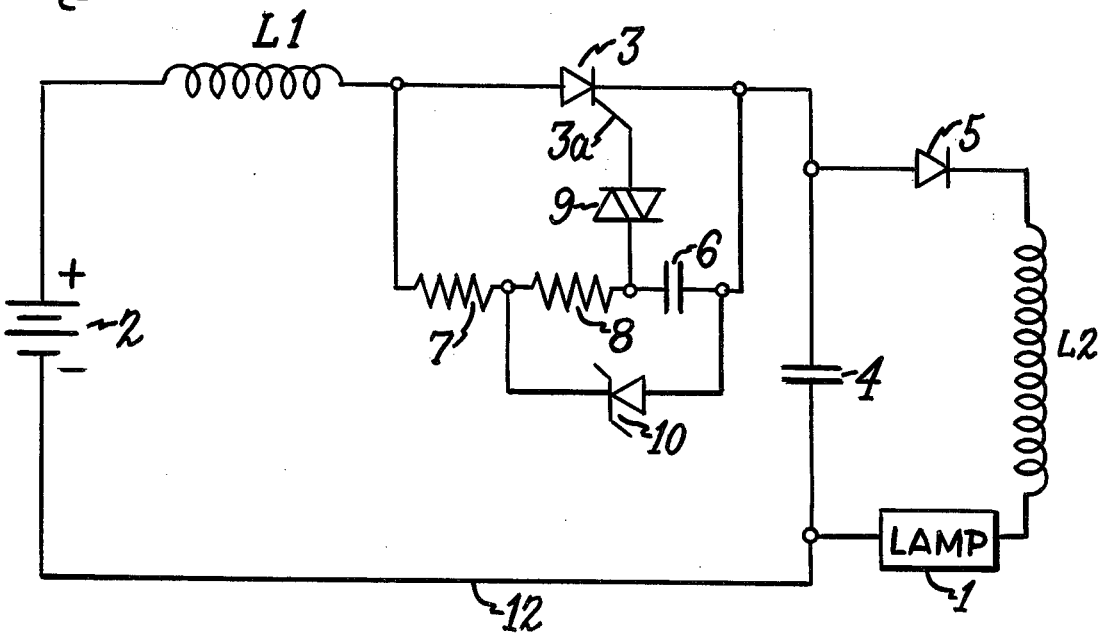

It has been found that arranging lamp 1 in various places in the series circuit of L1, SCR 3 and capacitor 4 will provide similar results, such as placing it between L1 and SCR 3, or between SCR 3 and the capacitor discharge loop, or in conductor 12. Lamp 1 may also be placed in the discharge loop in series with capacitor 4 across L2 as shown in FIG. 3, or in series with inductor L2 across capacitor 4 as shown in FIG. 4. Such modifications will produce varied but satisfactory results in accordance with the invention.

Inductor L1 may also be placed in various positions in the described series circuit while obtaining satisfactory results, and such modifications are intended to be included within the scope of the invention.

Figure 5:
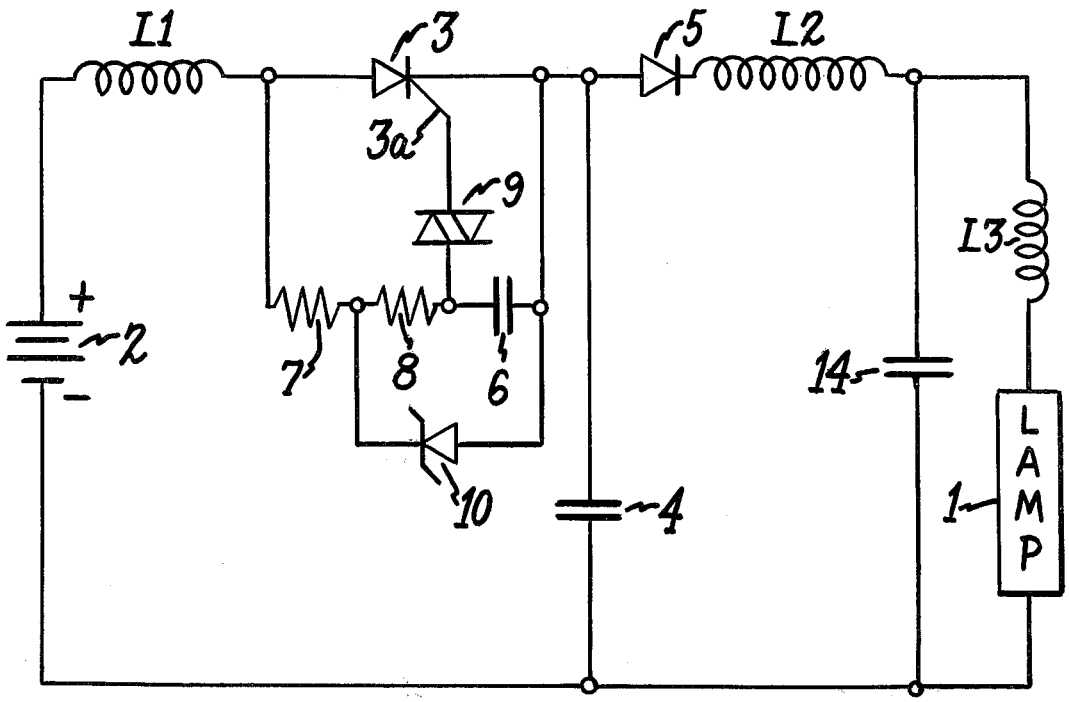
FIG. 5 is a circuit diagram of a different embodiment of the invention.

In the embodiment illustrated in FIG. 5, lamp 1 is in series with inductor L2 and across storage capacitor 14, which is arranged in the discharge loop comprising capacitor 4, diode 5 and inductor L2 and forms another discharge loop with lamp 1 and current limiting inductor L3 in series therewith. In the operation of this circuit, the energy on capacitor 4, similar to the operation previously described, is transferred through inductor L2 to capacitor 14, resulting in a charge reversal on capacitor 4. When the voltage on capacitor 14 reaches the ionization potential of lamp 1, the energy stored on capacitor 4 and capacitor 14 flows to the lamp through inductor L3. Capacitor 14 and inductor L3 may be selected to provide a desired current waveform for pulsed operation of the lamp. This arrangement provides for isolation of the lamp from the pulse generating circuit, allowing increased freedom in lamp current wave shaping.

While an SCR is disclosed as the unidirectional controlled switch in the described circuits, it will be understood that other equivalent switch devices may alternatively be employed in accordance with the invention. For example, a triac or a transistor switch may be employed in combination with a diode to provide unidirectional operation, and as used herein the expression "unidirectional controlled switch means" is intended to include all such equivalent switch devices or arrangements.

The power supply 2 may be any suitable source of DC voltage, such as a battery or a rectified AC source. Preferably, the DC supply is at least about 150 volts in order to achieve the desired improvement in color properties of lamp 1. Suitable circuits for obtaining direct current with low ripple factor which may be employed with the pulsing circuit of the invention are disclosed in co-pending application Ser. No. 608,531 - Neal, filed Aug. 28, 1975 and Ser. No. 692,078 - Morais, filed June 2, 1976, both assigned to the same assignee as the present invention. A high voltage starting circuit may be incorporated in the described circuit for starting lamp 1, as disclosed in the aforementioned Morais application.

A related type of circuit for DC pulsed operation of gaseous discharge lamps is disclosed in co-pending application Ser. No. 743,566 — Neal, filed Nov. 22, 1976, and assigned to the same assignee as the present invention.

While the present invention has been described with reference to particular embodiments thereof, it will be understood that numerous modifications may be made by those skilled in the art without actually departing from the scope of the invention. Therefore, the appended claims are intended to cover all such equivalent variations as come with the true spirit and scope of the invention.

What I claim as new and desire to secure by Letters Patent of the United States is:

1. A load operating circuit comprising, in combination, a direct current power source, a first inductor, unidirectional controlled switch means and a capacitor connected in series with each other across said power source, a second inductor of higher inductance than said first inductor connected across said capacitor and forming a discharge loop therewith, means for connecting a load across said power source in series with said first inductor and said unidirectional controlled switch means, and control means connected to said unidirectional controlled switch means for intermittently turning on the same at predetermined intervals, the ratio of inductance of said second inductor to the inductance of said first inductor being at least about 4:1 to provide for commutation of said unidirectional controlled switch means, whereby pulses may be applied to the load for operation thereof.

2. A load operating circuit comprising, in combination, a direct current power source, load connecting means, a first inductor, unidirectional controlled switch means and a capacitor connected in series with each other across said power source, a second inductor of higher inductance than said first inductor connected across said capacitor and forming a discharge loop therewith, and control means connected to said unidirectional controlled switch means for intermittently turning on the same at predetermined intervals, the ratio of inductance of said second inductor to the inductance of said first inductor being at least about 4:1 to provide for commutation of said unidirectional controlled switch means, whereby pulses may be applied to a load connected to said load connecting means for operation thereof.

3. A lamp operating circuit comprising, in combination, a direct current power source, a first inductor, unidirectional controlled switch means and a capacitor connected in series with each other across said power source, a second inductor of higher inductance than said first inductor connected across said capacitor and forming a discharge loop therewith, a gaseous discharge lamp connected across said power source in series with said first inductor and said unidirectional controlled switch means, and control means connected to said unidirectional controlled switch means for intermittently turning on the same at predetermined intervals, the ratio of inductance of said second inductor to the inductance of said first inductor being at least about 4:1 to provide for commutation of said unidirectional controlled switch means, whereby pulses are applied to said gaseous discharge lamp for operation thereof.

4. A circuit as defined in claim 3, wherein said ratio of inductance is about 10:1.

5. A circuit as defined in claim 3, and a diode arranged in series with said second inductor across said capacitor.

6. A circuit as defined in claim 3, wherein said lamp is arranged outside said discharge loop.

7. A circuit as defined in claim 3, wherein said lamp is arranged in said discharge loop.

8. A circuit as defined in claim 7, wherein said lamp is in series with said capacitor across said second inductor.

9. A circuit as defined in claim 7, wherein said lamp is in series with said second inductor across said capacitor.

10. A circuit as defined in claim 3, wherein said unidirectional controlled switch means comprises a silicon controlled rectifier.

11. A circuit as defined in claim 3, said control means comprising an RC timing circuit.

12. A circuit as defined in claim 11, and a Zener diode connected across said RC timing circuit for stabilizing the frequency of operation of said timing circuit.

13. A circuit as defined in claim 3, a storage capacitor connected in said discharge loop across said first mentioned capacitor, said gaseous discharge lamp connected across said storage capacitor and forming a second discharge loop therewith.

14. A circuit as defined in claim 13, and current limiting impedance means connected in said second discharge loop in series with said gaseous discharge lamp.

15. A lamp operating circuit comprising, in combination, a direct current power source, a gaseous discharge lamp, a first inductor, unidirectional controlled switch means and a capacitor connected in series with each other across said power source, a second inductor of higher inductance than said first inductor connected across said capacitor and forming a discharge loop therewith, and control means connected to said unidirectional controlled switch means for intermittently turning on the same at predetermined intervals, the ratio of inductance of said second inductor to the inductance of said first inductor being at least about 4:1 to provide for commutation of said unidirectional controlled switch means, whereby pulses are applied to said gaseous discharge lamp for operation thereof.

16. A circuit as defined in claim 15, wherein said gaseous discharge lamp is a high pressure sodium vapor lamp.

17. A load operating circuit comprising, in combination, input terminals for connection to a source of electrical current, a first inductor, unidirectional controlled switch means and a capacitor connected in series with each other across said input terminals, a second inductor of higher inductance than said first inductor connected across said capacitor and forming a discharge loop therewith, means for connecting a load across said input terminals in series with said first inductor and said controlled switch means, and control means connected to said controlled switch means for intermittently turning on the same at predetermined intervals, the ratio of inductance of said second inductor to the inductance of said first inductor being at least about 4:1 to provide for commutation of said unidirectional controlled switch means, whereby pulses may be applied to the load for operation thereof.

18. A circuit as defined in claim 17, and a diode in series with said second inductor across said capacitor.

* * * * *